US009750320B2

(12) United States Patent
Warm

(10) Patent No.: US 9,750,320 B2
(45) Date of Patent: Sep. 5, 2017

(54) DOLLAR COIN CONVERTER

(71) Applicant: Thomas Albert Warm, Mustang, OK (US)

(72) Inventor: Thomas Albert Warm, Mustang, OK (US)

( * ) Notice: Subject to any disclaimer, the term of this patent is extended or adjusted under 35 U.S.C. 154(b) by 0 days.

(21) Appl. No.: 14/612,985

(22) Filed: Feb. 3, 2015

(65) Prior Publication Data

US 2015/0181993 A1 Jul. 2, 2015

Related U.S. Application Data

(62) Division of application No. 14/255,176, filed on Apr. 17, 2014, now Pat. No. 9,038,885.

(51) Int. Cl.

| | |
|---|---|
| ***A45C 1/10*** | (2006.01) |
| ***B65D 25/10*** | (2006.01) |
| ***B65D 25/20*** | (2006.01) |

(52) U.S. Cl.

CPC ..... *A45C 1/10* (2013.01); *B65D 25/10* (2013.01); *B65D 25/205* (2013.01); *A45C 2001/102* (2013.01); *A45C 2001/104* (2013.01); *A45C 2200/05* (2013.01)

(58) Field of Classification Search

CPC ..... A45C 1/10; A45C 2001/102; A45C 2001/104; A45C 2200/05; B65D 25/205; B65D 25/10; A47G 1/12; G07D 9/002; A44C 21/00

USPC ..... 232/1 D; 206/0.8, 0.81, 0.82, 0.83, 0.84, 206/37, 38; 40/27.5

See application file for complete search history.

(56) References Cited

U.S. PATENT DOCUMENTS 632,938 A * 9/1899 Greenburg ..... B44B 5/008 194/214
2,196,850 A * 4/1940 Bostian ..... G09F 3/18 40/27.5
2,389,312 A * 11/1945 Honza ..... A47G 1/12 206/0.82
2,597,227 A * 5/1952 Colliton ..... A47G 1/12 206/0.82
3,069,001 A * 12/1962 Burdick ..... A47G 1/12 206/0.83
3,193,090 A * 7/1965 Hudgeons, Sr. ..... A47G 1/12 206/0.83
3,280,489 A * 10/1966 Bergmann ..... G07F 1/06 40/27.5
3,302,773 A * 2/1967 Weir ..... A47G 1/12 206/0.83
3,788,464 A * 1/1974 Skinner ..... A47G 1/12 206/0.82

(Continued)

*Primary Examiner* — William Miller

(57) ABSTRACT

The Dollar Coin Converter is an annular attachment to a United States dollar coin, which semi-permanently converts the coin into the same size and one-third the weight of a silver dollar. The converted coin is tactilely and visually, easily distinguished from the United States quarter coin.

It provides advertising incentives to distributors to circulate the converted coin, and marketing incentives to the public to circulate it, saving billions of dollars. The Dollar Coin Converter is made of inexpensive, one-piece or two-piece construction. It holds a dollar coin securely, and will tolerate normal handling, such as cash transactions. The coin may be easily removed or replaced, if it is needed for a vending machine. The converted dollar coin retains the inherent magnetic and electrical, anti-counterfeiting characteristics of the dollar coin.

2 Claims, 3 Drawing Sheets

(56) References Cited

U.S. PATENT DOCUMENTS 3,964,187 A * 6/1976 Stumpf ..... G09F 3/18 40/1.5
3,968,582 A * 7/1976 Jones ..... A44C 21/00 264/246
4,043,477 A * 8/1977 Deese ..... G09F 5/00 206/0.83
4,165,573 A * 8/1979 Richards ..... A44C 3/00 206/0.8
4,402,399 A * 9/1983 Friess ..... A47G 1/12 206/0.83
4,765,154 A * 8/1988 Martin ..... A44C 17/0208 63/23
4,878,579 A * 11/1989 Hager ..... A47G 1/12 206/0.83
5,011,005 A * 4/1991 Boyd ..... A47G 1/12 206/0.81
5,150,792 A * 9/1992 Munroe ..... A47G 1/12 206/0.84
5,407,064 A * 4/1995 Huang ..... A45C 1/02 206/0.8
5,427,233 A * 6/1995 Zinck ..... A61F 6/005 206/37
6,604,626 B1 * 8/2003 Hanshaw ..... A47G 1/12 206/0.81
7,322,512 B2 * 1/2008 Higer ..... A47G 1/12 206/0.8
2005/0167288 A1 * 8/2005 Sottile ..... A44B 15/005 206/38.1
2012/0199500 A1 * 8/2012 Trusso ..... A45C 1/02 206/0.8

* cited by examiner

DOLLAR COIN CONVERTER

BACKGROUND OF THE DOLLAR COIN CONVERTER

The Long Felt but Unsolved Need and Failure of Experts Factors

History

Replacing the U.S. one dollar bill with a U.S. one dollar coin would save billions of dollars, and reduce expensive landfill. Since 1975, the Mint, U.S. Treasury Dept., and the Federal Reserve have tried four times to circulate a small dollar coin. In each case the public has rejected the coin, primarily because the coin was too easily confused with the U.S. quarter coin. Billions of coins were returned to the Federal Reserve, where they remain. The Dollar Coin Converter converts the dollar coin about to the size of the silver dollar, so that the public will voluntarily circulate the dollar coin.

Below is a brief history of the failed attempts to circulate a dollar coin. The history is told mostly by quotes of experts and persons having ordinary skill in the art of coinage. References for the quotes are provided.

The Lesson

In 1875 The Mint struck a Twenty-Cent coin that was rejected by the U.S. public because the coin was too similar in size to the U.S. quarter coin. It was eight-hundredths inch smaller than the quarter. This was a lost opportunity to learn from experience about producing a coin the public would voluntarily circulate.

The First Documented Need

"It all began in the mid-1970s when the Research Triangle Institute was commissioned by the Treasury to study the coinage of this country and make recommendations for the future . . . ."

That report found that "the Eisenhower dollar has not been widely accepted by the public because of its large size and weight", but if the diameter was reduced by about a third, and the weight by about two-thirds, it might be used.

In January 1977, just prior to leaving office, President Ford's Treasury Secretary, William E. Simon, proposed the elimination of the cent and half dollar, and a reduction in size of the dollar.

The First Failure

In 1979 the Susan B. Anthony dollar coin was issued. "Everyone soon discovered that the coins were easily confused with quarter dollars." Cashiers were mistakenly giving out dollar coins instead of quarters in change. Bus companies and other facilities were refusing to accept them as payment.

" . . . the public recognized the problem immediately and they rejected it. The new dollar coin flopped and basically went out of circulation." "Within two or three months the chances of seeing one in daily use were practically nil." Even the Mint had trouble distinguishing the Anthony Dollar from the quarter.

"Had the promoters of the Anthony dollar taken the trouble to consider what happened to the 20-cent piece, which was too close in size and artwork to the quarter, they would have taken a much difference approach to the new dollar. Those who fail to learn the lessons of history are condemned to repeat its mistakes. The Anthony dollar is a classic case of this aphorism."

"Mint Director Stella Hackel Sims stated, 'people are accustomed to the Eisenhower dollar, but in time, they'll become accustomed to the Susan'." The Anthony dollar coin in nine-hundredths inch larger than the quarter coin. This was another lost opportunity to learn from experience about producing a coin the public would voluntarily circulate.

The Second Documented Need

And so, " . . . a new, blue ribbon, political committee was appointed to design a new dollar coin that overcame the objections of the public." This committee heavily represented the vending machine business. They had spent millions of dollars retrofitting all their coin operated machines to accommodate the Anthony dollar. They did not want to have to retrofit their machines again. Incredibly, " . . . they decided to launch the new dollar coins in the same form factor as had previously failed.", but with a different color.

The Second Failure

The golden Sacagawea dollar coin was launched in 2000. "The new dollar coin was heavily marketed by The Mint in a series of print, radio, and television advertisements, as well as Mint partnerships with Walmart and Cheerios." "The new dollar quarter was a resounding flop for precisely the same reasons that the first dollar quarter flopped. It was confusingly similar to the quarter."

The Third and Fourth Failures

Next came a patriotic appeal with the golden Presidential Dollar series (2007-present), and a cultural appeal with the Native American Series (2009-present). Neither is used frequently in general commerce today. The only minting done now is for collectors.

After 38 Years the Need Still Exists

" . . . the Fed's board of governors told Congress in June [2011] that the reserve system is holding more than $1.2 billion in dollar coins at 28 cash offices across the country . . . . The Fed cited a 2008 Harris poll that showed 76 percent of Americans prefer paper money" to the small dollar coin.

" . . . A U.S. Mint official claimed in a November 2012 meeting that most of 2.4 billion dollar coins minted in the previous five years sit in Federal Reserve vaults. The coins are so unloved, production was halted last year."

"The nonpartisan Congressional Accountability Office reported in March 2011 that switching from paper to metal would save taxpayers $5.5 billion over 30 years." In addition, it would benefit the environment by saving 66,000 tons of landfill waste.

In 2013 the consumer advocacy group Citizens Against Government Waste said "Eliminating the dollar bill in favor of the coin would save $13.8 billion over 30 years." . . . . Bi-partisan prominent U.S. senators, such as John McCain (R-AZ), Tom Harkin (D-IA), Mike Enzi (R-WY), Tom Coburn (R-OK), and Mark Udall (D-CO), have all supported this effort.

How the Dollar Coin Converter Addresses the Long Felt but Unsolved Need, and Failure of Others Factors Throughout the history of the dollar coins the notions of size and weight were repeatedly confounded. Over and over size and weight were cited as causes of lack of circulation of the silver dollar. Yet when The Mint issued small dollar coins with reduced size and weight, the result failed because of size, not weight. No one said they did not like the small dollar coin because it was too light, or that its weight was too similar to the weight of the quarter. It was always the size that was the problem. The small dollar coin was too similar in size to the quarter. The failure of the 1875 Twenty-Cent coin was also due to size. Its weight was less than the quarter.

The public has no inherent objection to a dollar coin. Silver dollars were minted for 37 years in competition with the paper $1 bill until the coin became more valuable as metal than as currency. "What nobody in the [1983 blue ribbon] committee ever thought to do was to put five of the new dollars into their pocket along with a bunch of other change and then see if they could pick out the dollar coins quickly."

The inescapable conclusion from this historical account is that, if the public is to accept the coin, the weight of the dollar coin can be reduced, but the size of the dollar coin must be distinguishable by touch or sight from the quarter coin.

That is exactly what the Dollar Coin Converter does. Drawing on precedence and lessons from history, the Dollar Coin Converter converts the small dollar's size back to the time-honored and successful size of the silver dollar and its easy tactile and visual distinction from the quarter coin, while leaving its weight at about one-third the weight of the silver dollar, and allowing convenient removal of the dollar coin from the converter for other purposes.

Applications of the Dollar Coin Converter

The Dollar Coin Converter converts the dollar coin into a form that is tactilely and visually, more easily distinguished from the quarter coin, so that the general public will voluntarily circulate the dollar coin. To do so requires several steps.

First, someone must pay to make them. Before anyone will pay, they must see a benefit to themselves to circulate them. That is what the indicia are for. Businesses will pay to get their name with their tag line on the converted dollar coin. The indicia are an inexpensive method to get entry into this form of advertising and marketing, that provide an incentive for the distributor to circulate the converted dollar coin.

Here is an example of a possible indicium for a fictitious retail store: WxyMart, Low Prices For Everyone. This indicium provides an opportunity for name recognition and familiarity and with a tag line indicating an advantage for shopping at WxyMart. The Dollar Coin Converter is an inexpensive way to advertise. It does not require huge initial expenses, such as for a TV commercial or newspaper advertisement. Not only does the customer see the advertising repeatedly, so does anyone to whom the customer circulates the converted dollar coin over and over again for as long as the Dollar Coin Converter lasts, perhaps years.

Another example of a possible indicium is, Worth $1.05 at WxyMart. In this indicium the converted dollar coin becomes a new form of money with the retailers name on it. When the customer receives the converted dollar coin in change, the customer is delighted to realize that more change has been received than expected. Moreover, the converted coin has more value than the dollar coin itself, allowing the retailer to advertise that literally "Your money is worth more at WxyMart." When the converted dollar coin is returned to the retailer and used to purchase another item, it amounts to a discount or coupon, in this example 5%, on any item in the store, but not on the entire price of the item. The discount is only on that part paid for with the converted dollar coin. If the retailer wishes, it could limit the number of converted dollar coins used to pay for a single item. When the retailer receives the converted dollar coin, the retailer can just re-circulate it to other customers, and does not have to purchase another one in its place.

If the dollar coin is needed for some other purpose, such as for a coin operated machine, the dollar coin can be removed. The owner of the annulus has the options to retain it and insert another dollar coin, or to discard it.

Implications of the Dollar Coin Converter

The potential benefits of the Dollar Coin Converter are enormous. The ultimate objective of the Dollar Coin Converter is to circulate the billions of dollar coins that sit in Federal Reserve banks, so that they can replace the one dollar bill.

As initial retailers circulate converted dollar coins, some will be spent at competing retailers. The competing retailers will want to circulate converted dollar coins with their own indicia. The effect will hopefully snowball. Even small retailers will be able to circulate converted dollar coins with their own indicia, because entry into this form of advertising and marketing is low cost.

As converted dollar coins become more and more popular, they will create an increased demand for dollar coins. More dollar coins will be requested from banks, which will in turn request more from the Federal Reserve banks.

Eventually, converted dollar coins will replace one dollar bills, which can at that point be discontinued, thus saving billions of dollars and thousands of tons of landfill required for the three billion dollar bills shredded per year.

FIELD OF THE INVENTION

An attachment or method to improve the circulation of the dollar coin as legal tender for cash transactions.

RELATED ART

In three patent searches I could find no related art, or even a suggestion of such prior art, for this function of the Dollar Coin Converter. I found no record that even the Blue Ribbon committees, convened to solve the problem, remotely conceived of such an idea. Apparently, attaching a removable prosthetic to remedy the limitation of the dollar coin was beyond imagination.

During two patent searches I reviewed 800 patents. They generally fell into four categories: tokens, coin holders, money carriers, and coin displays. They were narrowed down to a few representative patents, listed in the Patent Citations section, and having some similar characteristics.

U.S. Pat. No. 20050167288 A1 issued on Aug. 4, 2005, to Valerian Sottile, titled "Money holder," describes a container, which holds a plurality of coins for emergency use. To insert or remove the coins one unscrews the covers from the coupling member. A face of a coin can be seen from top or bottom. A key ring can be attached to the holder.

U.S. Pat. No. 2,193,850 A issued on Apr. 9, 1940, to Kenneth V. Bostian, titled "Coin attachment," describes a clear, plastic label with adhesive on part of one side, and indicia on the other side. The label can be attached to a coin with the adhesive, and is easily removed.

U.S. Pat. No. 3,280,489 issued on Oct. 25, 1966, to Conrad Bergmann, titled "Substitute Silver Dollar," describes an annulus the size of a silver dollar, within which a folded paper dollar bill is placed between clear plastic disks. The bill is folded such that the denomination of the bill is visible.

U.S. Pat. No. 3,964,187 issued on Jun. 22, 1976, to Elmer J. Stumpf, titled "Adjustable coin display device," describes an open, slotted annulus within which a single coin can be placed in the interior slot. The break in the annulus is bridged by a handle, which opens the annulus when squeezed inward. Coin can be displayed hanging with a string though handle.

U.S. Pat. No. 3,968,582 issued on Jul. 13, 1976, to Bernard B. Jones, titled "Gaming Token and process for fabricating same," describes two injection molded rings to form a token with tabs and stripes, into which coins can be inserted.

Token is constructed in an eight step process, and the coins are sealed in with molding compound.

U.S. Pat. No. 4,165,573 issued on Aug. 28, 1979, to Marjorie S. Richards, titled "Coin holder," describes a rectangular structure with a central hole into which a retainer ring with locking pins is placed to hold a coin securely, such that both sides of the coin are visible. Structure comes with a two-legged stand to hold coin up-right for easy viewing.

U.S. Pat. No. 4,765,154 A issued on Aug. 23, 1988, to Roger Martin, titled "Coin holder," describes an open annulus with flat tabs at the ends and an interior slot into which a coin can be inserted and held. The outer edge of each tab is threaded, and a hollow body with interior threads can be screwed onto the tabs, which pulls the tabs together and closes the annulus.

U.S. Pat. No. 5,011,005 issued on Apr. 30, 1991, to Alex Bally & 6 more, titled "Protective coin holder," describes a rectangular, protective cover with large interior chamber, into which a coin can be placed and displayed.

U.S. Pat. No. 5,407,064 A issued on Apr. 18, 1995, to Yu-Hwai Huang, titled "Coin carrier," describes a container with three annuli hinged together with a rivet allowing the annuli to be rotated, permitting coins to be placed into the inside annulus. Faces of the top and bottom coins are visible through the top and bottom annuli.

U.S. Pat. No. 7,322,512 B2 issued on Jan. 29, 2008, to Adam M. Higer, titled "Coin holder," describes a cardboard rectangle with 2 sets of concentric scored rings. The radii of the scored rings are selected to match existing coins, so that when rings smaller than a given coin are removed, the concentrically scored rings can be folded to contain the coin between transparent films.

PATENT CITATIONS

| Patent # | Filing Date | Publication Date | Applicant/Owner | Title |
|---|---|---|---|---|
| US20050167288A1 | Jan. 14, 2005 | Aug. 4, 2005 | Valerian Sottile | Money holder |
| U.S. Pat. No. 2,196,850 | Apr. 5, 1939 | Apr. 9, 1940 | Kenneth V. Bostian | Coin Attachment |
| U.S. Pat. No. 3,280,489 | Aug. 6, 1964 | Oct. 25, 1966 | Conrad Bergmann | Substitute Silver Dollar |
| U.S. Pat. No. 3,964,187 | Dec. 16, 1975 | Jun. 22, 1976 | Elmer J. Stumpf | Adjustable coin display device |
| U.S. Pat. No. 3,968,582 | Feb. 6, 1975 | Jul. 13, 1976 | Bernard B. Jones | Gaming token and process for fabricating same |
| U.S. Pat. No. 4,165,573 | Feb. 6, 1978 | Aug. 28, 1979 | Marjorie S. Richards | Coin holder |
| U.S. Pat. No. 4,765,154 | Feb. 11, 1987 | Aug. 23, 1988 | Roger Martin | Coin holder |
| U.S. Pat. No. 5,011,005 | Jul. 20, 1989 | Apr. 30, 1991 | Alex Bally, +6 More | Protective coin holder |
| U.S. Pat. No. 5,407,064 | Jul. 12, 1994 | Apr. 18, 1995 | Yu-Hwei Huang | Coin carrier |
| U.S. Pat. No. 7,322,512 | Jun. 9, 2006 | Jan. 29, 2008 | Adam M. Higer | Coin holder |

BRIEF SUMMARY OF THE DOLLAR COIN CONVERTER

The Dollar Coin Converter is typically an annular attachment to a United States dollar coin, which semi-permanently converts the coin to a size that is tactilely and visually, easy to distinguish from the United States quarter coin. With an inserted dollar coin the Dollar Coin Converter is about the same diameter but one-third the weight of a silver dollar. It is legal tender, and is convenient for commercial cash transactions. It provides retailers with a new, attractive, and economical opportunity for advertising and marketing. It provides both retailers and consumers with incentives to circulate the coin, thus potentially saving the United States government billions of dollars, and the environment thousands of tons of landfill by replacing the one dollar bill.

The Dollar Coin Converter is made of one-piece or two-pieces to reduce manufacturing costs. It holds a dollar coin securely, and will tolerate normal handling, such as cash transactions, flipping, or jostling in a coin purse, pocket or money bag without unintentional release. The coin may be easily removed and replaced even by a child or a person with long finger nails in case the coin is needed for a coin-operated machine or other purpose. The Dollar Coin Converter with inserted coin retains the anti-counterfeiting, magnetic and electrical characteristics of the coin.

ILLUSTRATION INDEX, 1$^{ST}$ EMBODIMENT

10 annulus
11 top face
12 outer ridge
14 inner ridge
16 rib
18 expanded rib
20 indicia
100 dollar coin

ILLUSTRATION INDEX, 2$^{ND}$ EMBODIMENT

20 top annulus
21 bottom annulus
22 indicia
24 flange
26 outer ridge
27 inner ridge
28 top annulus outside face
29 bottom annulus outside face
30 top annulus inside face
31 bottom annulus inside face
32 bottom outer wedge slope
34 bottom inner wedge slope
36 top outer wedge slope
38 top inner wedge slope
40 top adhesive area
42 bottom adhesive area
44 top terminal line
46 bottom terminal line
50 ribbon
90 folded annulus
92 two-piece annulus prior to adhesion
100 dollar coin

A BRIEF DESCRIPTION OF THE DRAWINGS

FIG. 0 is unlabeled views of two embodiments to be used as illustrations with the Abstract.

FIG. 1 through FIG. 2 refer to the first embodiment of the invention. FIG. 3 through FIG. 9*a* refer to the second embodiment of the invention.

Figure 1:
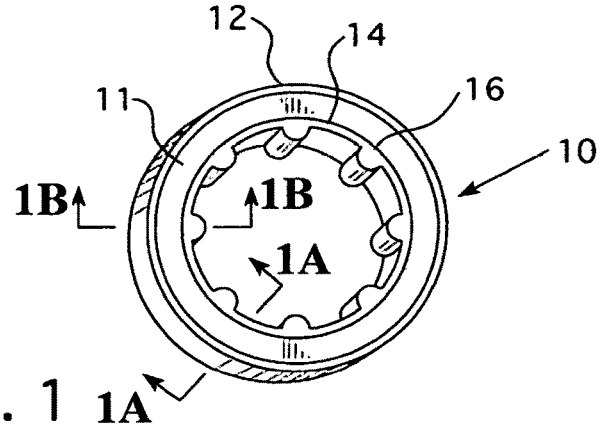
FIG. 1 is a perspective view of the annulus 10 of the first embodiment of the invention.
Figure 1A:
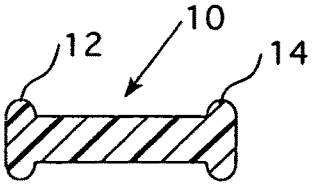
FIG. 1A is an enlarged, cross-sectional view on line 1A-1A of FIG. 1, showing a region of the first embodiment of the invention where there is no rib 16.
Figure 1B:
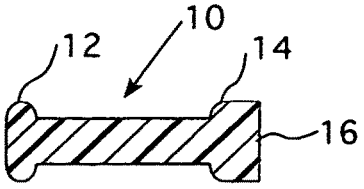

FIG. 1B is an enlarged, cross-sectional view on line 1B-1B of FIG. 1, showing a location where there is a rib 16, and ridges 12 and 14.

Figure 1C:
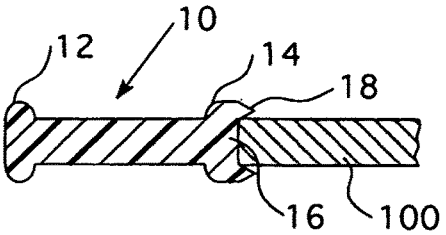
Figure 2:
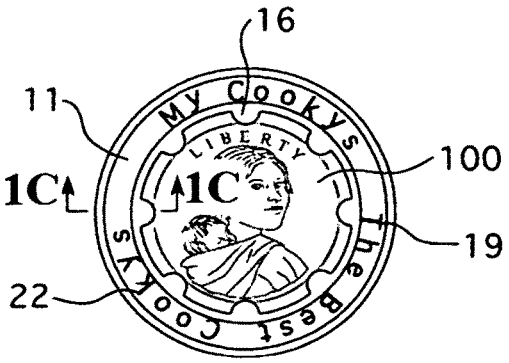

FIG. 1C is an enlarged, cross-sectional view on line 1C-1C of FIG. 2. A dollar coin 100 has compressed a rib 16, and the ends of the rib 16, which extend beyond the coin 100, have resiliently expanded and wrapped around the dollar coin 100.

FIG. 2 is a top view of the first embodiment with an inserted dollar coin 100, and illustrative indicia 19 on the top face of the annulus 10.

Figure 3:
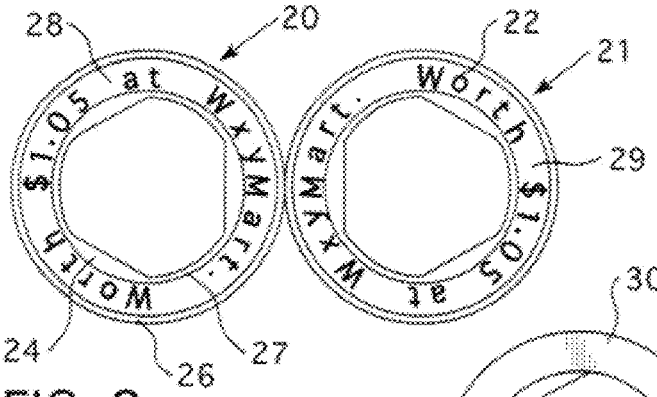

FIG. 3 is an outside view of the second embodiment of the invention, which is two annuli 20 and 21 joined together, and with illustrative indicia 22.

Figure 4:
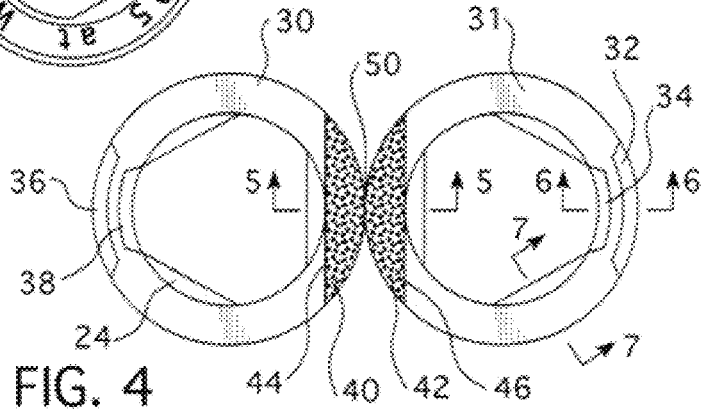

FIG. 4 is the inside view of the two annuli, attached by a thin ribbon 50.

Figure 5:
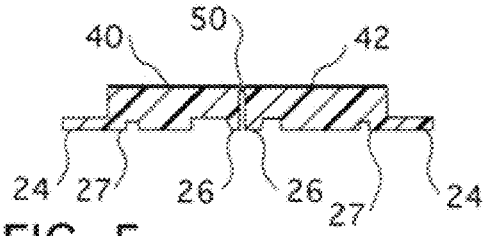

FIG. 5 is an expanded cross-sectional view at line 5-5 of FIG. 4.

Figure 6:
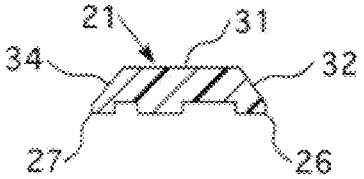
Figure 6A:
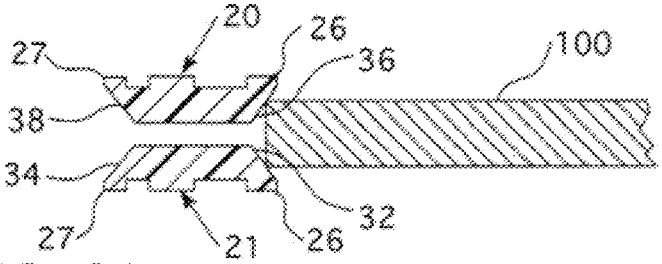

FIG. 6 is an expanded cross-sectional view of line 6-6 of FIG. 4,

FIG. 6A is an expanded cross-sectional view of line 6-6 of FIG. 4 after annuli 20 and 21 have been folded together, and shows a dollar coin 100 beginning to wedge apart the top outer wedge slope 36 and the bottom outer wedge slope 32.

Figure 6B:
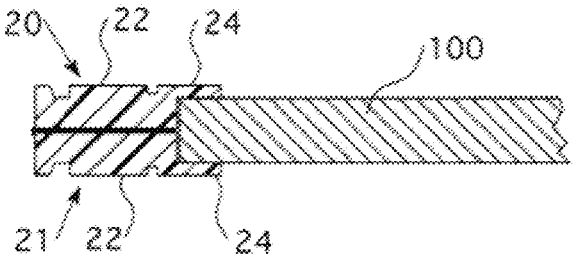

FIG. 6B is an expanded cross-sectional view of line 5-5 of FIG. 4, after annuli 20 and 21 have been folded together and the dollar coin 100 inserted, showing how flanges 24 hold the dollar coin 100 in the second embodiment of the Dollar Coin Converter.

Figure 7:
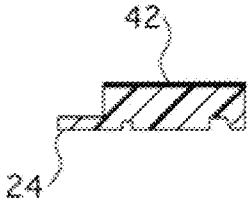

FIG. 7 is an expanded cross-sectional view of line 7-7 of FIG. 4, showing the annulus at a location where there is no flange or wedge slope.

Figure 8:
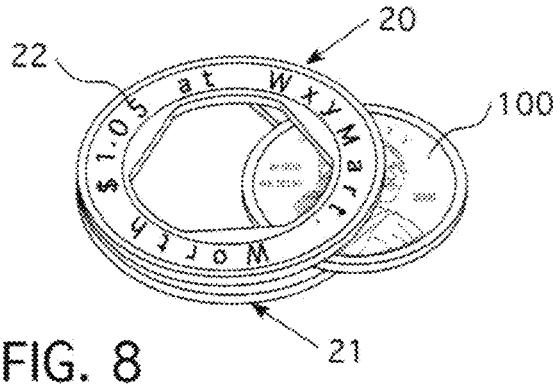

FIG. 8 shows a perspective view of a dollar coin 100 being inserted into the second embodiment of the Dollar Coin Converter.

Figure 9:
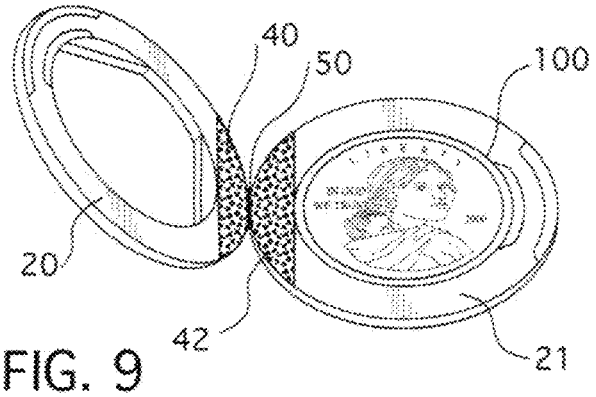

FIG. 9 shows a perspective view of top annulus 20 being folded with the dollar coin 100 having been placed into bottom annulus 21.

Figure 9A:
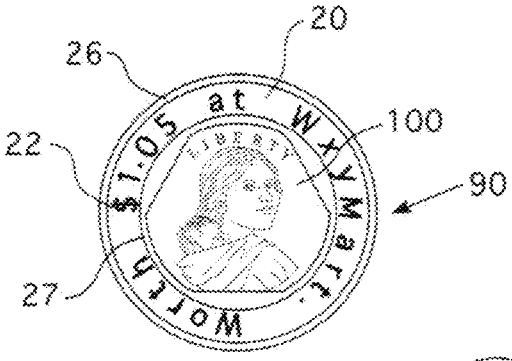

FIG. 9A shows a top view of the completed second embodiment of the Dollar Coin Converter containing a dollar coin 100 and illustrative indicia 22.

Figure 9B:
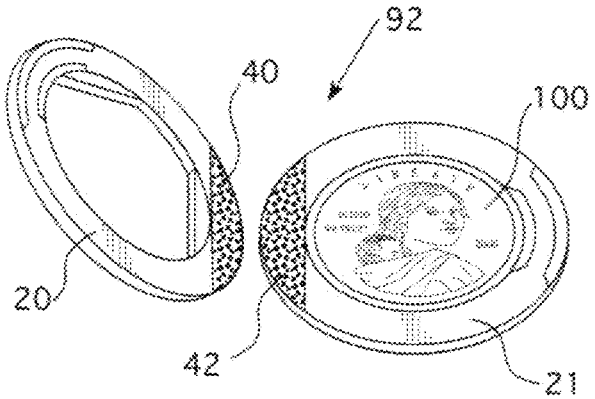

FIG. 9B shows a perspective view of two-piece construction without a ribbon 50. The top annulus 20 is prepared for adhesion to the bottom annulus 21 into which a dollar coin 100 has been inserted.

DETAILED DESCRIPTION OF THE DOLLAR COIN CONVERTER

The Dollar Coin Converter converts the small U.S. dollar coin, such as the coin known as the Sacagawea dollar, into a size that the public will voluntarily circulate. The Dollar Coin Converter makes the dollar coin tactilely and visually, more easily distinguished from the U.S. quarter coin, thus removing the nuisance value of the tactual and visual similarity of the dollar coin to the quarter coin that has caused the dollar coin's unpopularity.

The Dollar Coin Converter is an annulus into which the dollar coin is semi-permanently inserted. The coin is held sufficiently securely to withstand normal coin handling, such as cash transactions, flipping, and jostling in purse, pocket, or money bag without unintentional release. In its first embodiment the converted dollar coin is about the size of a Morgan silver dollar, but about one-third its weight.

If needed for another purpose, the dollar coin can be removed from the converter, even by a child or a person with long finger nails, and another dollar coin can be inserted.

The faces of the annulus can contain indicia to provide businesses and consumers incentives to circulate the converted dollar coin. Most of each face of the coin remains uncovered to retain the inherent anti-counterfeiting, magnetic and electrical characteristics of the dollar coin.

The converter is of one-piece or two-piece construction to contain manufacturing costs. The converter can be constructed of many materials, such as plastic, aluminum, cardboard, wood, or pressed fiber, provided the material meets the functional requirements of the embodiment, such as durability, compression, resilience, or flexibility.

The First Embodiment

FIGS. 1, 1A, 1B, 1C, and 2 refer to the first embodiment of the Dollar Coin Converter.

FIG. 1 is a perspective view of an annulus 10 with a circumferential outer ridge 12 and a circumferential inner ridge 14 on each face 11, and a plurality of semicircular ribs 16 mounted vertically from face 11 to face. The ends of the ribs 16 extend and attach to the inside edge of the inner ridges 14. The bottom face, which is not shown, is identical to the top face 11, except perhaps the indicia 22.

FIG. 1A is an enlarged, cross-sectional view on line 1A-1A of FIG. 1, showing a region of the annulus 10 with ridges 12,14 but without a rib 16. FIG. 1B shows a region with a rib 16.

FIG. 1C is an enlarged, cross-sectional view on line 1C-1C of FIG. 2, showing a dollar coin 100 pressed into the annulus 10, compressing the rib 16, with the ends 18 of the ribs 16 expanding around the dollar coin 100 to provide secure retention.

FIG. 2 is a top view of the first embodiment with an inserted dollar coin 100, and illustrative indicia 22 on the top face 11. When the dollar coin 100 is inserted, the semicircular ribs 16 are compressed, holding the dollar coin 100 securely by friction, and by the expanded ends 18 of ribs 16.

The first embodiment requires a material that is compressible and resilient, such as nylon.

The Second Embodiment

FIGS. 3 through 9B refer to the second embodiment of the Dollar Coin Converter.

The second embodiment requires a material that is flexible and resilient, such as acrylic plastic.

The second embodiment is two annuli 20,21 joined in a clam shell configuration by a thin, narrow ribbon 50 made of the same material as the annuli 20,21, so that the annuli 20,21 can be folded to form a single annulus 90 as in FIG. 9A.

The outside face 28,29 of each annulus 20,21 has an outer ridge 26 and inner ridge 27 to protect the indicia 22 from wear. The thicknesses of the top annulus 20 and bottom annulus 21 are each about half the thickness of the first embodiment in FIG. 1, so that when the two annuli 20,21 are folded together, the annuli 20,21 form a single annulus 90 with about the same overall dimensions as the first embodiment in FIG. 1.

Around the interior edge of each annulus 20,21 is a plurality of flanges 24 attached to the inner ridges 27. The flanges 24 serve to retain the dollar coin 100 between the two folded annuli 20,21, while leaving most of both faces of the dollar coin 100 uncovered. The thickness of the flanges 24 is about the same as the height of the inner ridge 27.

FIG. 4 is the inside view of the two annuli 20,21 attached by a thin, narrow ribbon 50, made by the same material as the annuli 20,21. The ribbon 50 guides the folding of the two annuli 20,21 together to form the folded annulus 90 in FIG. 9A. Adjacent to the ribbon 50 is a speckled adhesive application area 40,42 on each annulus. The adhesive areas 40,42 extend from the ribbon 50 to a line tangent 44,46 to the nearest point of the inside edge of each annulus. During manufacturing, adhesive is applied to the adhesive areas 40,42 prior to folding, and permanently holds the annuli 20,21 together after folding. Alternatively, the two annuli 20,21 without the ribbon 50 can be adhered together to form a two-piece construction 92 as in FIG. 9B.

FIG. 6 is an expanded cross-sectional view of line 6-6 of FIG. 4. FIG. 6 shows bottom inner 34 and outer wedge slopes 32. The wedge slopes 32,34 each form about a 45 degree angle with the plane of the inside face 30,31 of the annulus 20,21 of which it is a part.

FIG. 6A is an expanded cross-sectional view of line 6-6 of FIG. 4 of the bottom wedge slopes 32,34 plus the corresponding top wedge slopes 36,38 after the annuli 20,21 have been folded during manufacturing. The space between the pair of outer wedge slopes 32,36 and the space between the pair of inner wedge slopes 34,38 are wedge spaces. The function of the wedge spaces is to allow a dollar coin 100 to get started wedging apart the annuli 20,21 without the use of a tool or fingernail, so that the dollar coin 100 can be inserted into or removed from the Dollar Coin Converter.

FIG. 6B is an expanded cross-sectional view of line 5-5 of FIG. 4 after the dollar coin 100 has been inserted, and the annuli 20,21 have been folded together, showing how the flanges 24 retain the dollar coin 100.

FIG. 7 is an expanded cross-sectional view of line 7-7 of FIG. 4 to clarify the difference between cross-sections where wedge slopes 32,34,36,38 exist such as at line 6-6 of FIG. 4 as in FIG. 6, and where wedge slopes do not exist such as at line 7-7 of FIG. 4.

FIG. 8 shows a perspective view of the dollar coin 100 being inserted into the folded annulus 90 after the adhesive has been applied to the adhesive areas 40,42 and the annuli 20,21 have been folded together. The locations of example indicia 22 are also shown.

FIG. 9 shows a perspective view of the annuli 20,21, being folded with the dollar coin 100 having been placed into the bottom annulus 21 during manufacture.

FIG. 9A shows a top view of the finished second embodiment of the Dollar Coin Converter containing the dollar coin 100.

FIG. 9B shows a step during two-piece construction. The two annuli 20,21 are separate pieces without the connecting ribbon 50. The top annulus 20 is prepared for adhesion to the bottom annulus 21 into which a dollar coin 100 has been inserted.

Another Embodiment

A throw-away embodiment would allow easy removal of the dollar coin from the Dollar Coin Converter, but the dollar coin converter would be damaged. In this embodiment a dollar coin 100 can not be replaced with another dollar coin 100.

This enumeration of these embodiments does not exclude the many other possible embodiments of the Dollar Coin Converter.

The invention claimed is:

1. A manufactured structure with a large interior hole into which hole a United States dollar coin is removably inserted, whereby said structure securely retains said dollar coin and provides an enhanced tactile and visual means to distinguish said dollar coin from the United States quarter coin as legal tender for commercial cash transactions, comprising a. a top annulus and a bottom annulus connected by a short, thin, narrow ribbon to have a clamshell form factor, b. a first outer ridge attached to the outer edge of the outside face of said top annulus, and a first inner ridge attached to the inner edge of said outside face of said top annulus, c. a second outer ridge attached to the outer edge of the outside face of said bottom annulus, and a second inner ridge attached to the inner edge of said outside face of said bottom annulus, d. a plurality of flanges are attached to the inner ridge of said top annulus outside face, and another plurality of flanges are attached to the inner ridge of said bottom annulus outside face, all extending inwardly toward the center of said annuli within the plane of the respective face to which ridge they are attached, e. said narrow, thin ribbon serves as a hinge and connects said outer edge of the inside face of said top annulus to said outer edge of the inside face of said bottom annulus, whereby said top annulus and said bottom annulus are attached, forming a single folded annulus, f. on said inside face of each annulus is an adhesive area, covering a segment of each respective annulus from said ribbon to a line tangent to the nearest point on the inside edge of said respective annulus, g. located on a segment on the opposite side of said hole from said ribbon on each annulus, are inner and outer wedge slopes to facilitate the insertion and removal of said dollar coin, h. said wedge slopes each form an acute angle with the plane of said respective inside faces of respective said top and bottom annuli, i. said top annulus and said bottom annulus can be folded and held permanently together by said adhesive areas, forming said single folded annulus, j. when inserted into said folded annulus said dollar coin is designated a converted dollar coin, is mostly uncovered on both sides and retains the inherent anti-counterfeiting, magnetic and electrical characteristics of said dollar coin, k. at least one outside face of said annuli contains functionally related indicia, which provide an incentive to circulate said converted coin.

2. A United States dollar coin converter comprises:

a. a one-piece or two-piece structure with a large interior hole defining an annulus into which hole a United States dollar coin is inserted, resulting in a generally coin-shaped converted coin not larger than a silver dollar which is legal tender for commercial cash transactions and is distinguished from the United States quarter coin both tactilely and visually, b. said structure allows insertion and removal of said dollar coin, wherein said dollar coin is securely retained in said structure by physically obstructing said dollar coin from unintentional release from said structure via a plurality of flanges attached to inside edges of said annulus, wherein said flanges extend inwardly toward a center of said annulus within the plane thereof to extend over both sides of said dollar coin, c. said dollar coin is mostly uncovered on said both sides when securely retained in said structure and readily testable using the inherent anti-counterfeiting, magnetic and electrical characteristics of said coin, and d. at least one outer face of said structure contains functionally related indicia, which provides an incentive to circulate said converted coin, and which indicates the amount of additional monetary value and its source added to said converted coin, whereby removal of said structure from said dollar coin would remove said additional monetary value.

* * * * *